US005674427A

United States Patent [19]

Videbæk et al.

[11] Patent Number: 5,674,427

[45] Date of Patent: Oct. 7, 1997

[54] COMPOSITION FOR THE TREATMENT OF DYED FABRIC

[75] Inventors: Thomas Videbæk, Hellerup, Denmark; Walter H. Westendorp, Loon op Zand, Netherlands

[73] Assignee: Novo Nordisk A/S, Bagsvaerd, Denmark

[21] Appl. No.: 444,115

[22] Filed: May 18, 1995

Related U.S. Application Data

[62] Division of Ser. No. 318,845, Oct. 24, 1994, Pat. No. 5,565,006.

[30] Foreign Application Priority Data

Sep. 27, 1993 [DK] Denmark ..... 1093/93
Jan. 20, 1994 [DK] Denmark ..... 88/94

[51] Int. Cl.[6] ..... C11D 3/386

[52] U.S. Cl. ..... 252/8.91; 8/102; 8/107; 8/110; 8/115; 510/320; 510/392

[58] Field of Search ..... 8/102, 107, 110, 8/114.6, 115, 115.51, 116.1; 252/8.6, 8.8, 8.9, 145, 160, 173, 174.12, 8.91, 8.84, 8.85, 8.86; 510/276, 320, 392, 323, 281, 321; 424/94.1, 94.6, 94.61; 435/263, 183, 187, 195, 209

[56] References Cited

U.S. PATENT DOCUMENTS

| | | | |
|---|---|---|---|
| 4,287,080 | 9/1981 | Siklosi | 510/235 |
| 4,575,887 | 3/1986 | Viramontes | 8/158 |
| 4,769,172 | 9/1988 | Siklosi | 510/407 |

FOREIGN PATENT DOCUMENTS

| | | |
|---|---|---|
| 0 307 564 A2 | 7/1988 | European Pat. Off. . |
| WO 95/02790 | 3/1990 | WIPO . |
| WO 90/07569 | 7/1990 | WIPO . |
| WO 92/18687 | 10/1992 | WIPO . |
| WO 95/09225 | 4/1995 | WIPO . |

OTHER PUBLICATIONS

Kochavi et al. "Optimizing Processing Conditions in Enzymatic Stonewashing", American Dyestuff Reporter, Sep. 1990, pp. 24, 26 and 28.

*Primary Examiner*—Alan Diamond
*Attorney, Agent, or Firm*—Steve T. Zelson, Esq.; Valeta Gregg, Esq.

[57] ABSTRACT

A composition comprising a cellulase, heat expanded perlite and a buffer and optionally a dispersing agent and/or a chelating agent useful for the treatment of a dyed fabric.

3 Claims, No Drawings

COMPOSITION FOR THE TREATMENT OF DYED FABRIC

This is a divisional application of application Ser. No. 08/318,845 filed Oct. 24, 1994 now U.S. Pat. No. 5,565,006, the contents of which are incorporated herein by reference in their entirety.

FIELD OF INVENTION

The present invention relates to a composition for the treatment of dyed fabric, e.g. denim or jeans, and a process for providing improved localised variation in the colour density of the surface of dyed fabric, especially cellulosic fabric such as denim.

More specifically, the invention relates to a composition comprising a cellulolytic enzyme, perlite, buffer and optionally a a dispersing agent and/or a chelating agent.

BACKGROUND OF THE INVENTION

The most usual method of providing a "stone-washed" look (localized abrasion of the colour) in denim fabric or jeans is by washing the denim or jeans made from such fabric in the presence of pumice stones to provide the desired localized lightening of the colour of the fabric. Using pumice for this purpose has the disadvantage that pumice particles have to be washed from the fabric or clothing subsequently to treatment, and that the pumice stones and particles cause a significant wear of the machines used in the process. Also, handling large amounts of stones may be a problem.

Other approaches to providing a "stone-washed" appearance to denim fabric or jeans have therefore been suggested. For instance, enzymes, in particular cellulolytic enzymes, have been suggested for this purpose, either alone (U.S. Pat. No. 4,832,864) or together with a smaller amount of pumice than required in the traditional process.

It has been suggested that it may be advantageous to substitute pumice with perlite, especially heat expanded perlite, in the stonewashing process. Since perlite has a considerably lower density than pumice, this substitution may reduce the mentioned disadvantages of using pumice.

However, it has turned out that the desired "stonewashed" look of dyed fabric can not be obtained by using perlite instead of pumice stones in the conventional stonewashing process, i.e. by treating ("stone-washing") the fabric in the presence of perlite.

Perlite may be a dusting material and especially the handling thereof when carrying out the "stone-washing" process may create dust which is unpleasant and annoying to the personnel and even dangerous to their health, and, furthermore, requires frequent cleaning of the process area.

Thus, there is still a need for an improved method of providing a stone-washed look in dyed fabric which eliminates the handling problems of the known methods while at the same time being cost-efficient as well as for an improved composition for the treatment of dyed fabric.

SUMMARY OF THE INVENTION

It has surprisingly been found that excellent results may be obtained by using cellulolytic enzymes in combination with perlite, especially heat expanded perlite, for providing improved localised variation in the colour density of dyed fabric such as for providing a "stone-washed look".

Further, it has surprisingly been found possible to eliminate the perlite dust from the enzymatic "stone-washing" process described above by preparing a composition comprising perlite, a cellulolytic enzyme and a buffer and optionally a dispersing agent and/or a chelating agent which composition may be used in the process of the present invention.

An additional advantage of using the process and/or the composition according to the present invention for the treatment of dyed fabric is that by using the process and/or the composition for artificially obtaining an aged look and softness of e.g. denim clothing, particularly jeans, it is possible to reduce the required amount of perlite below 10 weight %, presumably to about 5–2 weight %, as compared to the amount of pumice conveniently used in combination with a cellulolytic enzyme.

Also, the presence of perlite and buffer seems to increase the performance of the cellulolytic enzyme. It has been found that a desired stone-washed look may be obtained by using the composition of the invention which comprises less enzymatic activity than is required when using the known process involving enzyme and pumice, the composition of the invention thus being more cost effective than the known method using either enzymes alone or together with pumice.

Thus, the efficiency, low price and non-toxic and non-irritant properties of the composition of the present invention makes the composition very useful.

DETAILED DESCRIPTION OF THE INVENTION

The composition of the invention is most beneficially applied to cellulose-containing fabrics, such as cotton, viscose, rayon, ramie, linen, lyocell (Tencel) or mixtures thereof, or mixtures of any of these fibres. In particular, the fabric is denim. The fabric may be dyed with vat dyes such as indigo, direct dyes such as Direct Red 185, sulphur dyes such as Sulfur Green 6, or reactive dyes fixed to a binder on the fabric surface.

In a most preferred embodiment of the process of the invention, the fabric is indigo-dyed denim, including clothing items manufactured therefrom.

The cellulolytic enzyme comprised by the composition of the invention may be any cellulase previously suggested for this purposes, e.g. as described in U.S. Pat. No. 4,832,864 which is hereby incorporated by reference. Thus, the cellulolytic enzyme may be of microbial origin, preferably a fungal or bacterial cellulase.

According to the invention, it has been found that acid as well as neutral and alkaline cellulases may be employed.

The terms "acid cellulase", "neutral cellulase", and "alkaline cellulase", respectively, are intended to mean a cellulase having its optimum activity or performance at an acid pH (preferably below about pH 6), neutral pH or an alkaline pH (preferably above about pH 8, more preferably above about pH 9), respectively.

Examples of suitable acid cellulases are those obtainable or derivable from a strain of the genera Trichoderma, Irpex, Clostridium or Thermocellum. Examples of suitable neutral or alkaline cellulases are those obtainable or derivable from a strain of the genera Humicola, Fusarium, Bacillus, Cellulomonas, Pseudomonas, Myceliophthora or Phanerochaete. Preferred cellulases may be obtained from the fungal species *Humicola insolens*, more preferred from the fungal species *Humicola insolens*, DSM 1800 (deposited at Deutsche Sammlung von Mikroorganismen according to the Budapest Treaty on 1 Oct. 1981). A currently preferred cellulase is a ~43 kD endoglucanase obtainable from *Humi-*

*cola insolens*, DSM 1800, e.g. as described in WO 91/17243 which is hereby incorporated by reference. Most preferred, the ~43 kD endoglucanase is a monocomponent cellulase, i.e. an endoglucanase obtained by conventional recombinant techniques such as cloning and expression in a homologous or heterologous host cell.

Preferably, the cellulolytic enzyme is present in the composition of the invention in an amount which is efficient for providing improved localised variation in the colour density of the surface of dyed fabric. The required amount of enzyme is dependent of the activity of the enzyme.

In a preferred embodiment of the invention, the enzyme is an endoglucanase. The cellulolytic activity of endoglucanase is determined relative to an analytical standard and may be expressed in the unit EGU (endoglucanase unit) or in the unit ECU. Preferably, the composition of the invention comprises an amount of endoglucanase corresponding to 20–300 EGU or ECU, more preferably 20–200 EGU or ECU, especially 40–150 EGU or ECU per gram of the composition.

Cellulolytic enzymes hydrolyse CMC, thereby increasing the viscosity of the incubation mixture. The resulting reduction in viscosity may be determined by a vibration viscosimeter (e.g. MIVI 3000 from Sofraser, France).

Determination of the cellulolytic activity, measured in terms of ECU, may be determined according to the analysis method (assay) described below.

The ECU assay quantifies the amount of catalytic activity present in the sample by measuring the ability of the sample to reduce the viscosity of a solution of carboxymethylecellulose (CMC). The assay is carried out at 40° C.; pH 7.5; 0.1M phosphate buffer; time 30 min; using a relative enzyme standard for reducing the viscosity of the CMC (carboxymethylcellulose Hercules 7 LFD) substrate; enzyme concentration approx. 0.15 ECU/ml. The arch standard is defined to 8200 ECU/g.

The unit EGU (endoglucanase unit) is determined relative to an enzyme standard at the following reaction conditions: pH 6.0; 0.1M phosphate buffer; 34.0 g/l substrate (carboxymethylcellulose Hercules 7 LFD); temperature 40° C.; time 30 min; enzyme concentration approx. 0.020 EGU/ml. The arch standard is defined to 880 EGU/g.

The buffer may suitably be a phosphate, borate, citrate, acetate, adipate, triethanolamine, monoethanolamine, diethanolamine, carbonate (especially alkali metal or alkaline earth metal, in particular sodium or potassium carbonate, or ammonium and HCl salts), diamine, especially diaminoethane, imidazole, or amino acid buffer. Preferably, the buffer is a mono-, di-, or triethanolamine buffer.

The buffer is preferably present in the composition of the invention in an amount of 1–50 w/w %, more preferably 5–40 w/w %, especially 15–35 w/w %, based on the total weight of the composition.

Perlite is a naturally occuring volcanic rock. Preferably, heat expanded perlite is used, preferably having a density (sand) of 2200–2400 kg/m$^3$ and a bulk density of 40–100 kg/m$^3$. In a preferred embodiment of the invention, the heat expanded perlite is particular, preferably having a particle size between 0.2 mm and 20 mm, more preferably between 0.3 mm and 10 mm, especially between 1 mm and 5 mm.

The heat expanded perlite is preferably present in the composition of the invention in an amount of 20–95 w/w %, more preferably 25–80 w/w %, especially 30–65 w/w %, based on the total weight of the composition.

The composition of the invention is preferably a solid composition comprising heat expanded perlite mixed together with cellulolytic enzyme and buffer and optionally dispersing agent(s) and/or chelating agent(s). The solid composition of the invention is a ready-for-use product which may be applied directly to the machines conventionally used for the stonewashing process. The solid composition typically comprises a suspension of the cellulolytic enzyme composition in a solid matrix which may be inorganic or organic. The solid composition of the invention may be in the form of granules, granulates, or pellets.

It has been experimentally established that particularly advantageous results may be obtained by using the composition of the invention when the composition additionally comprises a dispersing agent.

The dispersing agent may suitably be selected from nonionic, anionic, cationic, ampholytic or zwitterionic surfactants. More specifically, the dispersing agent may be selected from carboxymethylcellulose, hydroxypropylcellulose, alkyl aryl sulphonates, long-chain alcohol sulphates (primary and secondary alkyl sulphates), sulphonated olefins, sulphated monoglycerides, sulphated ethers, sulphosuccinates, sulphonated methyl ethers, alkane sulphonates, phosphate esters, alkyl isothionates, acyl sarcosides, alkyl taurides, fluorosurfactants, fatty alcohol and alkylphenol condensates, fatty acid condensates, condensates of ethylene oxide with an amine, condensates of ethylene oxide with an amide, block polymers (polyethylene glycol, polypropylene glycol, ethylene diamine condensed with ethylene or propylene oxide), sucrose esters, sorbitan esters, alkyloamides, fatty amine oxides, ethoxylated monoamines, ethoxylated diamines, ethoxylated polyamines, ethoxylated amine polymers and mixtures thereof.

Preferably, the dispersing agent is an ethoxylated fatty acid ester or a nonylphenyl polyethyleneglycol ether.

The dispersing agent is preferably present in the composition of the invention in an amount of 0.1–10 w/w %, more preferably 0.5–8 w/w %, especially 0.5–5 w/w %, based on the total weight of the composition.

In another aspect of the invention, it is possible to improve the ability of cellulolytic enzymes to provide localized colour variations in dyed fabrics by adding a chelating agent to the composition.

The chelating agent may be one which is soluble and capable of forming complexes with di- or trivalent cations (such as calcium) at acid, neutral or alkaline pH values. The choice of chelating agent depends on the cellulase employed in the process. Thus, if an acid cellulase is included, the chelating agent should be one which is soluble and capable of forming a complex with di- or trivalent cations at an acid pH. If, on the other hand, the cellulase is neutral or alkaline, the chelating agent should be one which is soluble and capable of forming a complex with di- or trivalent cations at a neutral or alkaline pH.

The chelating agent may suitably be selected from aminocarboxylic acids; hydroxyaminocarboxylic acids; hydroxycarboxylic acids; phosphates, di-phosphates, tri-polyphosphates, higher poly-phosphates, pyrophosphates; zeolites; polycarboxylic acids; carbohydrates, including polysaccharides; hydroxypyridinones; organic compounds comprising catechol groups; organic compounds comprising hydroxymate groups; silicates; or polyhydroxysulfonates.

When the chelating agent is a hydroxycarboxylic acid, it may suitably be selected from gluconic acid, citric acid, tartaric acid, oxalic acid, diglycolic acid, or glucoheptonate.

When the chelating agent is a polyamino- or polyhydroxyphosphonate or -polyphosphonate, it may suitably be selected from PBTC (phosphonobutantriacetat), ATMP (aminotri(methylenphosphonic acid)), DTPMP (diethylene triaminpenta(methylenphosphonic acid), EDTMP ethylene diamintetra(methylenphophonic acid)), HDTMP (hydroxyethyl-ethylendiamintri(methylenphosphonic acid) ), HEDP (hydroxyethane diphosphonic acid), or HMDTMP (hexamethylen-diamine tetra(methylene phosphonic acid)).

It is contemplated that particularly advantageous results may be obtained by using the composition of the invention when the composition additionally comprises a polymeric agent.

The polymeric agent may be one which is capable of either adsorbing to the fabric in question or solubilising the dye in question. Examples of suitable polymers include proteins (e.g. bovine serum albumin, whey, casein or legume proteins), protein hydrolysates (e.g. whey, casein sr Soy protein hydrolysate), polypeptides, lignosulfonates, polysaccharides and derivatives thereof,polyethylene glycol, polypropylene glycol, polyvinyl pyrrolidone, ethylene diamine condensed with ethylene or propylene oxide, ethoxylated polyamines, or ethoxylated amine polymers.

In one aspect, the present invention relates to a process for providing localised variation in the colour density of the surface of dyed fabric, the process comprising contacting, in an aqueous medium, a dyed fabric with a composition comprising a cellulolytic enzyme, heat expanded perlite, and a buffer, and optionally a dispersing agent, and/or a chelating agent.

Thus, the process of the invention involve contacting dyed fabric or clothing items with an aqueous solution or suspension comprising the composition of the invention and agitating the fabric or clothing for a sufficient period of time to produce localised variations in colour density of the surface of the fabric or clothing. The fabric items may be wet by the solution or suspension and agitated in the aqueous solution or suspension of the present composition.

The amount of composition used to treat the dyed fabric typically depends on the ratio of cellulolytic enzyme, buffer and perlite in the composition and the dry weight of the dyed fabric to be washed. Typically, the composition used in the process of the invention contain a minimum of 20 EGU or 20 ECU of endoglucanase and a minimum of 20 w/w % of perlite to obtain the stone-washed look. In a preferred mode the dyed fabric may be contacted with about 40–150 EGU or 40–150 ECU of endoglucanase per liter of washing liquor for 75 minutes at about 55° C. The preferred pH is dependent on the pH optimum of the cellulolytic enzyme, i.e. whether an acid, neutral, or alkaline cellulase is applied.

A preferred composition of the invention comprises 20–95 (w/w) % of perlite, an amount of cellulolytic enzyme which is efficient for providing localised variation in the colour density of the surface of dyed fabric, 1–50 (w/w) % of buffer, and optionally 0.1–10 (w/w) % of dispersing agent and/or 0.1–10 (w/w) % of chelating agent, based on the total weight of the composition.

The present composition may be formulated in commonly available industrial mixers. Typically the liquid enzyme composition and the buffer are mixed and added to the heat expanded perlite sufficiently slowly to create a uniform enzyme dispersion.

The present composition are typically used in water in household, institutional, or industrial machines having a circular drum held in a horizontal or vertical mode in order to produce the stone-washed appearance. Most commonly the fabric is added to the machine according to the machine capacity per the manufacturer's instructions. The fabric may be added prior to introducing water into the drum or may be added to water in the machine or to the water comprising the composition of the invention. The fabric is contacted with the composition and agitated in the machine for a sufficient period to ensure that the fabric is fully wetted and to ensure the action of the cellulolytic enzyme and the perlite on the fabric material.

The invention is further described in the following examples which are not intended to as in any way limiting the scope of the invention.

EXAMPLE 1

Compositions of the invention

The following compositions were prepared:

Composition A:

Perlite (type 0515 available from Nordisk Perlite ApS, Denmark)

Cellulase enzyme (~43 kD endoglucanase from *Humicola insolens*, DSM 1800, produced by Novo Nordisk A/S, Bagsvaerd, Denmark): 84 ECU/g of perlite Triethanolamine (85%): 0.83 g/g of perlite Dispersant (Berol® 08 from Nobel Kemi AB): 0.083 g/g of perlite Berol® 08 is a nonionic surfactant (ethoxylated $C_{18}$-fatty acid ester). The average number of oxyethylene units in Berol® 08 is 80.

Composition B:

Perlite (type 0515)

Cellulase enzyme (cellulase preparation obtained from *Humicola insolens*, DSM 1800, produced and sold by Novo Nordisk A/S, Bagsvaerd, Denmark): 51 EGU/g of perlite Phosphate buffer (70% $KH_2PO_4$+30% $Na_2HPO_4.2H_2O$): 0.83 g/g of perlite Dispersant (Berol® 08 from Nobel Kemi AB): 0.083 g/g of perlite Composition C:

Perlite (type 0515) Cellulase enzyme (An acid cellulase preparation obtained from *Trichoderma reesei*; produced and sold by Novo Nordisk A/S, Bagsvaerd, Denmark): 98 EGU/g of perlite Triethanolamine (85%): 0.75 g/g of perlite Dispersant (Berol® 08 from Nobel Kemi AB): 0.083 g/g of perlite

EXAMPLE 2

Treatment of dyed fabric with the composition of the invention (stone-washing) and comparison with known methods The following experiments were carried out:

Materials and methods:

A 12 kg Wascator FL 120 wash extractor using 40 liters of water was used for stone-washing 2.6 kg of fabric.

Fabric: 14½ oz. Dakota (indigo-dyed denim) from Swift Textiles.

Machine load: 2.6 kg-40 l of water.

Three processes/enzyme compositions were tested:

A: Treatment with 80 g of a commercial cellulase preparation, 142 EGU/g, obtained from *Humicola insolens*, DSM 1800; available from Novo Nordisk A/S, Bagsvaerd, Denmark.

B: As A but treatment with 150 g instead of 80 g of the cellulase preparation mentioned under A.

C: Treatment with 60 g of the cellulase preparation mentioned under A. and addition of 0.5 kg pumice stones per kg denim fabric.

D: Treatment with 333 g of the following composition of the invention:

56 w/w % of heat expanded perlite, 22.5 w/w % of triethanolamine, 8 w/w % of citric acid/sodium citrate, 5.5 w/w % of dispersant (Berol® 08 from Nobel Kemi AB), and 0.25 w/w % of ~43 kD endoglucanase, approx. 70 ECU/g, obtained from *Humicola insolens*, DSM 1800; produced by Novo Nordisk A/S, Bagsvaerd, Denmark.

The denim was placed in the machine, the composition was added and the machine washing cycle was started.

The "stone-washing" was carried out at a temperature of 55°–60° C. and a pH of about 7 for 60 min.

The abrasion level was determined by measuring the reflection at a wavelength of 420 nm using a reflectometer (Texflash 2000) and the result was confirmed by visual evaluation in a lightbox.

The results are shown in the table below.

| Process/ composition | Amount of cellulase | Pumice stones | Abrasion level % R at 420 nm |
|---|---|---|---|
| A | 11360 EGU | — | 11.46 |
| B | 21300 EGU | — | 12.71 |
| C | 8520 EGU | 0.5 kg/kg | 13.36 |
| D | 22975 ECU | — | 14.51 |

The results demonstrate that the abrasion level is improved considerably by using the composition of the invention in comparison with treatment according to the known processes, i.e. either enzymatic treatment alone or enzymatic treatment in combination with washing with pumice.

EXAMPLE 3

Elutriation dust

The following experiment was carried out in order to determine the dusting effect of the composition of the invention in comparison with conventional heat expanded perlite.

Method:

The sample was elutriated in a glass column. The released dust was accumulated on a filter, and the quantity was determined.

60.0 g of the sample was placed on a perforated steel plate placed approximately 7 cm above the bottom of a glass column having an inner diameter of 0.0345 m and a total length of 1.83 m. The glass column was connected with a filter holder by a plastic tube. To avoid any depositing of dust on the outside of the filter holder, the plastic tube was led inside the filter holder. The filter holder was a perforated stainless steel plate in a tightly sealed stainless steel holder. The filter (a Whatman 15.0 cm GF/C glass fibre filter) was weighed and placed in the filter holder. The exhaust ventilator and the air flow was started, and the air flow was adjusted to 2.69 $m^3/h$~0.8 m/s. The air was conditioned to a relative humidity of 40–50% during fluidization. The total fluidization time was 40 min. The air inlet and the exhaust ventilator was stopped, and the dust on the filter holder cover was transferred to the filter, the filter was weighed and the amount of dust collected was determined.

Samples:

Two samples were tested:

Sample 1: Perlite (type 0515, particle size 1.5–1.5 mm).

Sample 2: Composition A according to Example 1.

| Results: | mg dust collected |
|---|---|
| Sample 1: (Perlite) | 216.0 |
| Sample 2: (Comp. of the invention) | 1.4 |

It can be concluded that the dust problem occurring when using heat expanded perlite is almost eliminated by using the composition of the invention.

We claim:

1. A composition for the treatment of dyed fabric comprising a cellulolytic enzyme, heat expanded perlite and a buffer.

2. The composition of claim 1, wherein the heat expanded perlite has a matrix and the cellulolytic enzyme is suspended in the matrix.

3. The composition of claim 2, wherein said composition is a solid form selected from the group consisting of granules, granulates, and pellets.

* * * * *